US009168981B2

(12) United States Patent
Ferretti

(10) Patent No.: US 9,168,981 B2
(45) Date of Patent: Oct. 27, 2015

(54) BOAT WITH A STERN HATCH HAVING TWO OPENING OPTIONS

(71) Applicant: FERRETTI S.p.A., Cattolica (Rimini) (IT)

(72) Inventor: Norberto Ferretti, Cattolica (IT)

(73) Assignee: FERRETTI S.P.A., Cattolica (Rimini) (IT)

( * ) Notice: Subject to any disclaimer, the term of this patent is extended or adjusted under 35 U.S.C. 154(b) by 0 days.

(21) Appl. No.: 14/254,225

(22) Filed: Apr. 16, 2014

(65) Prior Publication Data

US 2014/0311394 A1 Oct. 23, 2014

(30) Foreign Application Priority Data

Apr. 23, 2013 (IT) ..... MI2013A0665

(51) Int. Cl.
*B63B 17/00* (2006.01)
*B63B 19/14* (2006.01)
*B63B 27/14* (2006.01)

(52) U.S. Cl.
CPC ..... *B63B 19/14* (2013.01); *B63B 27/143* (2013.01)

(58) Field of Classification Search
USPC ..... 114/361, 362, 201 R
IPC ..... B63B 19/14,27/14, 27/143
See application file for complete search history.

(56) References Cited

U.S. PATENT DOCUMENTS

| | | | | |
|---|---|---|---|---|
| 5,441,005 | A | 8/1995 | Freeman et al. | |
| 7,237,503 | B2 * | 7/2007 | Stepp | 114/361 |
| 2005/0253406 | A1 * | 11/2005 | Faubert et al. | 296/51 |
| 2006/0130724 | A1 | 6/2006 | Huff et al. | |
| 2009/0051188 | A1 * | 2/2009 | Foussianes et al. | 296/65.01 |

OTHER PUBLICATIONS

The Extended European Search Report dated Jul. 10, 2014 for European patent application No. 14162196.1.

* cited by examiner

*Primary Examiner* — Stephen Avila
(74) *Attorney, Agent, or Firm* — Novak Druce Connolly Bove + Quigg LLP

(57) ABSTRACT

A boat includes a hull having an aft stern hatch located in an inner aft compartment of the aforesaid hull, the hatch having a body with opposing flanks or sides pivoted on the hull, and upper and lower edges. The hatch includes pivot members associated with the flanks or sides in the proximity of the upper edge and in the proximity of the lower edge, the pivot members being movable towards the inside and towards the outside of these flanks so they can protrude from the flanks in combination or alternatively to each other, thereby allowing the hatch to assume, alternatively, a position in which it is closed on to the compartment, a first position of opening to an upper part of the hull, or a second position of opening to a lower part of the hull.

16 Claims, 7 Drawing Sheets

BOAT WITH A STERN HATCH HAVING TWO OPENING OPTIONS

CROSS-REFERENCE TO RELATED APPLICATIONS

This claims the priority of Italian Patent Application No. MI2013A000665 filed on 23 Apr. 2013.

The present invention relates to a boat according to the preamble of the principal claim.

Boats with an aft compartment, having at least one stern hatch for closing the compartment, have been known for a considerable time. A compartment of this type is used, for example, to house a small boat or tender. It is also known that many luxury boats have, in their aft part, a stern platform formed by a projecting surface adapted to serve as a "swim platform" for the passengers on the boat.

However, the presence of this swim platform may impede direct access to the aft compartment from the sea; in fact, although it allows the presence of a compartment, it does not permit the construction of a floodable aft compartment. On the other hand, in boats having no stern platform, the presence of the movable hatch allows the compartment to be flooded and makes it easy to launch the tender.

The object of the present invention is to provide a boat having a floodable aft compartment while also having the stern "swim platform".

In particular, the object of the invention is to provide a boat in which the same stern hatch acts both as a closure for the aft compartment and as a stern deck or swim platform, the hatch being, evidently, movable for the purpose of opening the aft compartment and allowing access thereto.

A further object is that of providing a boat of the aforesaid type in which the stern hatch can be used in a reliable way in each position which it assumes with respect to the hull.

These and other objects, which will be evident to those skilled in the art, are achieved by a boat according to the appended claims.

To facilitate the understanding of the present invention, the following drawings are attached purely by way of non-limiting example, in which drawings.

Figure 1:
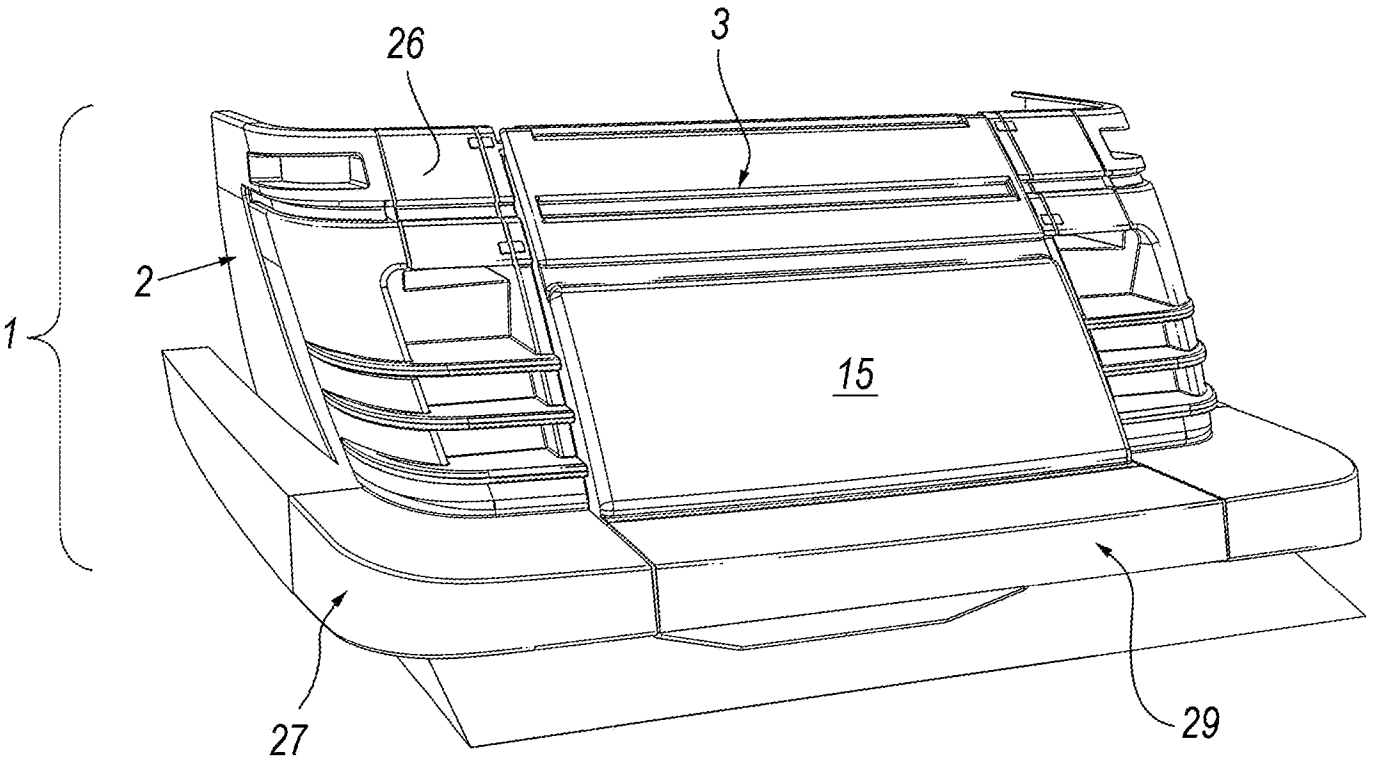
FIG. 1 shows the stern of a boat made according to the invention, with the stern hatch closed.

With reference to the aforesaid figures, a boat 1 is shown (partially and in its aft portion only) as having a hull 2 with a stern hatch 3 adapted to close an aft compartment 4 adapted to contain a small boat such as a dinghy or a tender (not shown). This compartment 4 has opposing lateral walls 6 on which are pivoted hydraulic and/or pneumatic actuators 7 adapted to enable the hatch 3 to be opened. In particular, each of these actuators 7 is associated with a wall 6 at its first end 8, the second end 9 being pivoted on an inner wall 10 of the hatch by means of eyes 11 fixed to this wall.

The stern hatch 3 has an outer wall 15 (generally made of fibreglass, like the portion of the hull), spaced apart from the wall 10 and connected thereto by lateral flanks 16 and 17 and upper and lower edges 20 and 21; these walls 10 and 15, the edges 16 and 17 and the sides 20 and 21 form a body 25 of the hatch. The actuators 7 are pivoted in the proximity of the flanks 16.

The outer wall 15 can be positioned coplanarly with a stern wall 26 of the boat 1 when the hatch is closed. For this purpose, the hatch 3 has registration members, not shown, adapted to enable the position of the hatch with respect to the wall 26 to be adjusted, both in a plane parallel to this wall (in other words by a movement of the hatch parallel to itself) and about an axis (of rotation) lying in this plane (for example, the median axis of the hatch). By means of the latter movement, the hatch can be made to undergo very small rotations about this axis so as to place it in the appropriate position with respect to the wall 26.

The registration members may be of any of the wide variety of known types, and will therefore not be described further.

A stern platform 27 projects from the bottom of the stern wall 26 and is adapted to form a aft lateral extension of the boat. Preferably, a part 29 of this platform, located at the position of the hatch 3, is movable so as to allow the ingress of water into the aft compartment 4, which is thus floodable.

Figure 2:
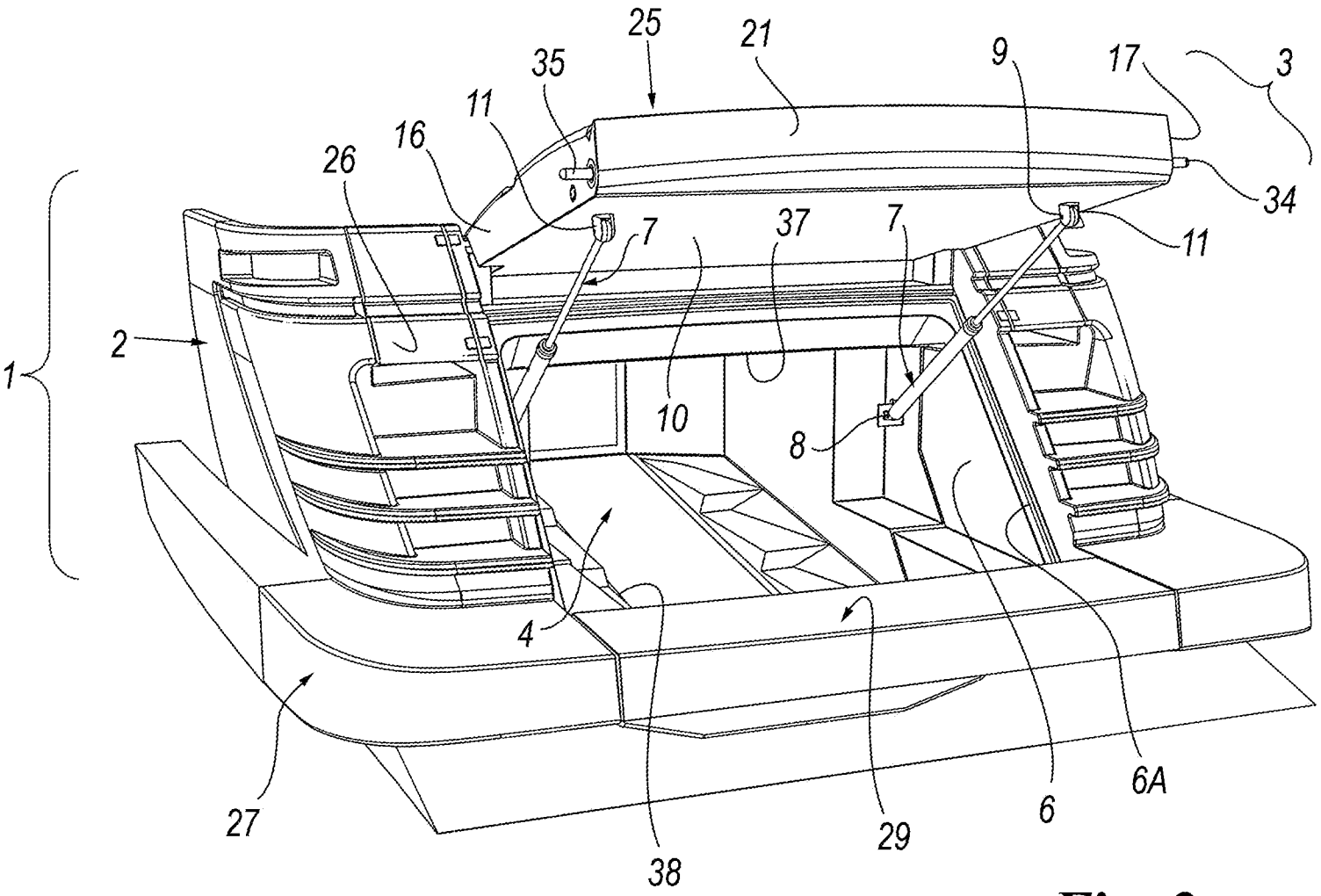
FIG. 2 shows the stern of the boat of FIG. 1, with the hatch opened upwards.

According to the invention, the hatch 3 can be pivoted selectively on the lateral walls 6 in positions such that it can, alternatively, rotate upwards (with respect to the "mouth" 6A of the compartment 4) or downwards, while, evidently, remaining coupled to the hull 2 at the "pivot points". In the first case, access is provided to the aforesaid compartment (this access being further facilitated by the movement of the part 29 downwards with respect to the mouth 6A of the compartment) for a dinghy or tender (FIGS. 2 and 4); in the second case (FIG. 3), a deck (or "swim platform") projecting from the hull 2 is created, for the use of passengers on the vessel.

Figure 3:
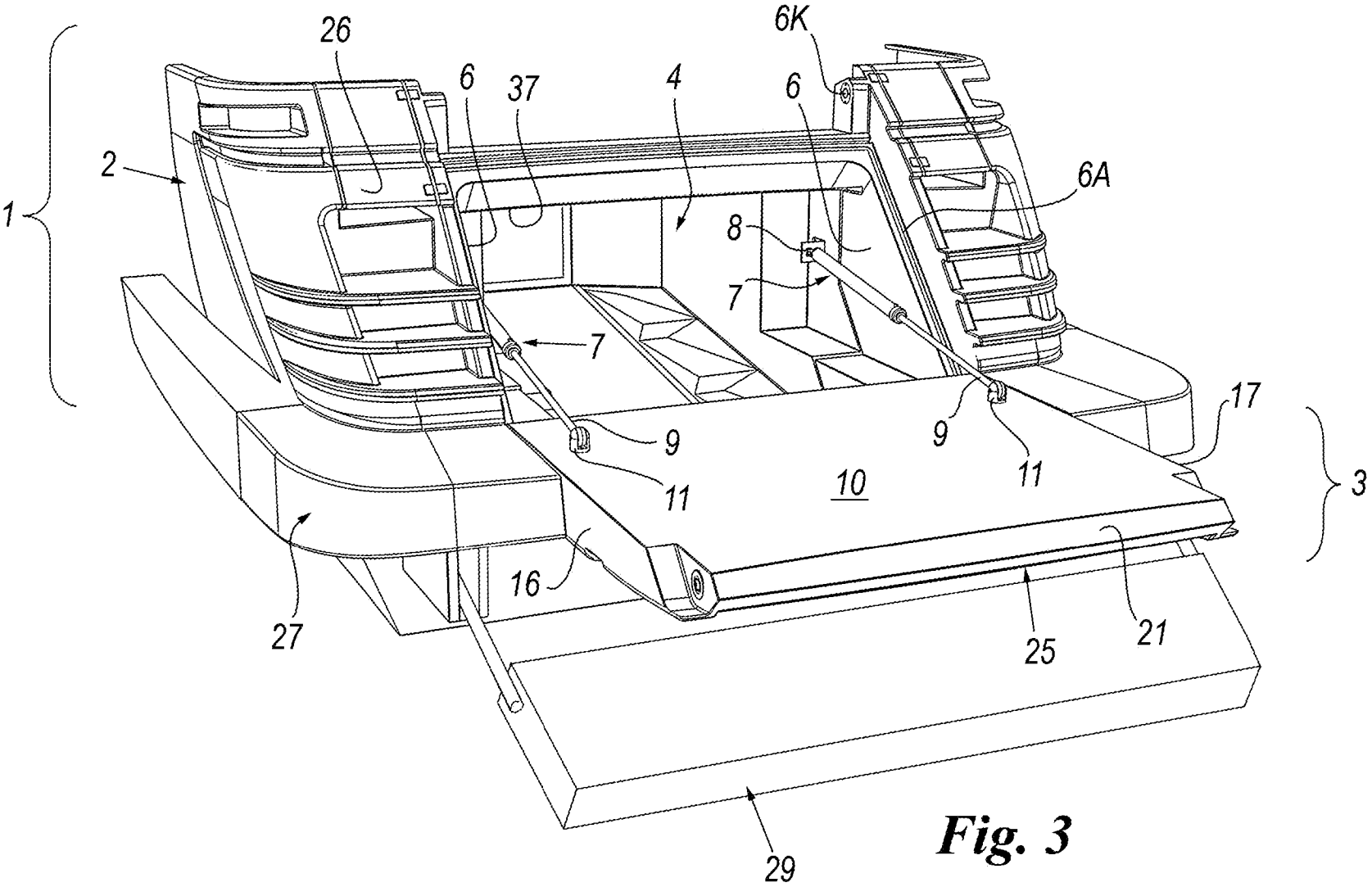
FIG. 3 shows the stern of the boat of FIG. 1, with the hatch opened downwards.
Figure 4:
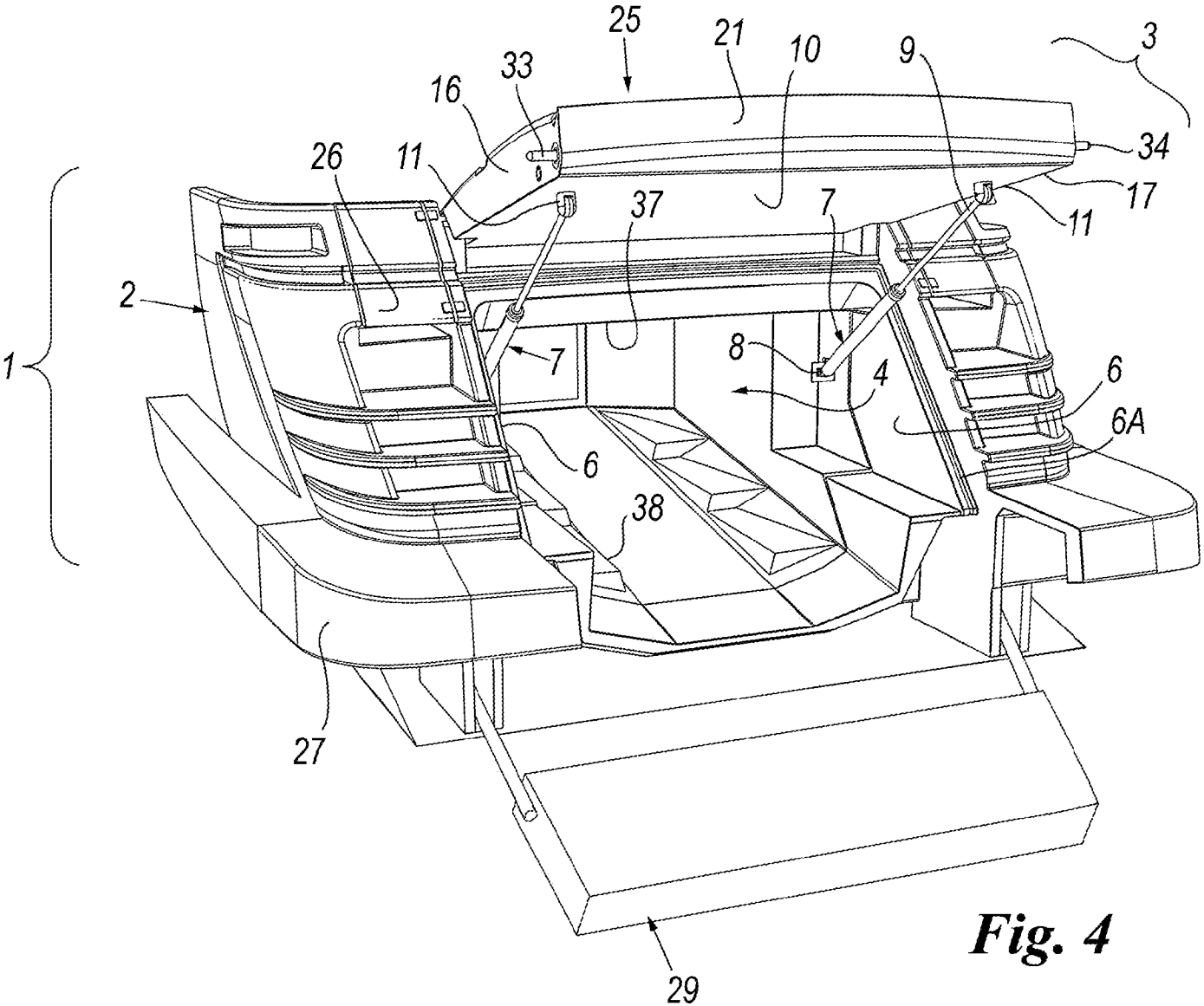
FIG. 4 shows the stern of the boat in a mode of use in which an aft compartment of the hull is open.

In order to provide these two possible movements of the hatch, a device 40 is placed in the hatch body 25 between the walls 10 and 15, for selectively moving pairs of pins 31, 32 and 33, 34 (forming pivot means which always keep the hatch 3 secured to the hull 2), located near the upper edge 20 and the lower edge 21, respectively, of the body 25, these pins being adapted to emerge from the corresponding flanks 16 and 17 so as to interact with holes or seats (only one of which, indicated by 6K, is shown in FIG. 3) in the walls 6 of the compartment 4 located near the mouth 6A and near the upper walls 37 and lower walls 38 of this mouth.

Clearly, in the present text, the terms "upper" and "lower" are to be understood with reference to FIGS. 1-4 or with reference to the hull of the boat. The terms "left" and "right" are to be interpreted with reference to FIGS. 1-4.

The device 40 has identical driven portions 41 and 42 coupled, respectively, to each pair of pins (or pivots 31, 32; 33, 34). These portions are interconnected by an actuator portion 44 interposed between them. Since the portions 41 and 42 are identical, only a first of them will be described, the elements of the other portion being indicated on the drawings by the same reference numerals as those of the first portion, with the addition of the letter A.

The portion 41 comprises a transverse element 45 connecting the lateral flanks 16 and 17 of the hatch 3. This portion comprises first ends 46 of a pair of first curved links 47 with their concavity facing the corresponding flank 16 or 17. Second ends 48 of these links 47 are pivoted on corresponding second links 49 pivoted at their first ends 50 on the transverse element 45 and at their second ends 52 on bars 54 carrying the pins 31, 32. The pins emerge from corresponding tubular protrusions 55 associated with the flanks 16 and 17 of the hatch 3.

The links 49 are also curved towards the flanks near them, in the same way as the links 47. This shape not only reduces the sizes of the mechanical parts (to allow their positioning in the body 25 of the hatch 3) but also allows the pins 31 and 32 to be moved by small movements of the links.

Clearly, the transverse element 45 may be replaced, as a fastening for the second links 49, by parts directly associated with at least one of the walls 10 and 15 of the hatch 3, for the purpose of fastening the first ends 50 of the links to the aforesaid body 25.

Figure 5:
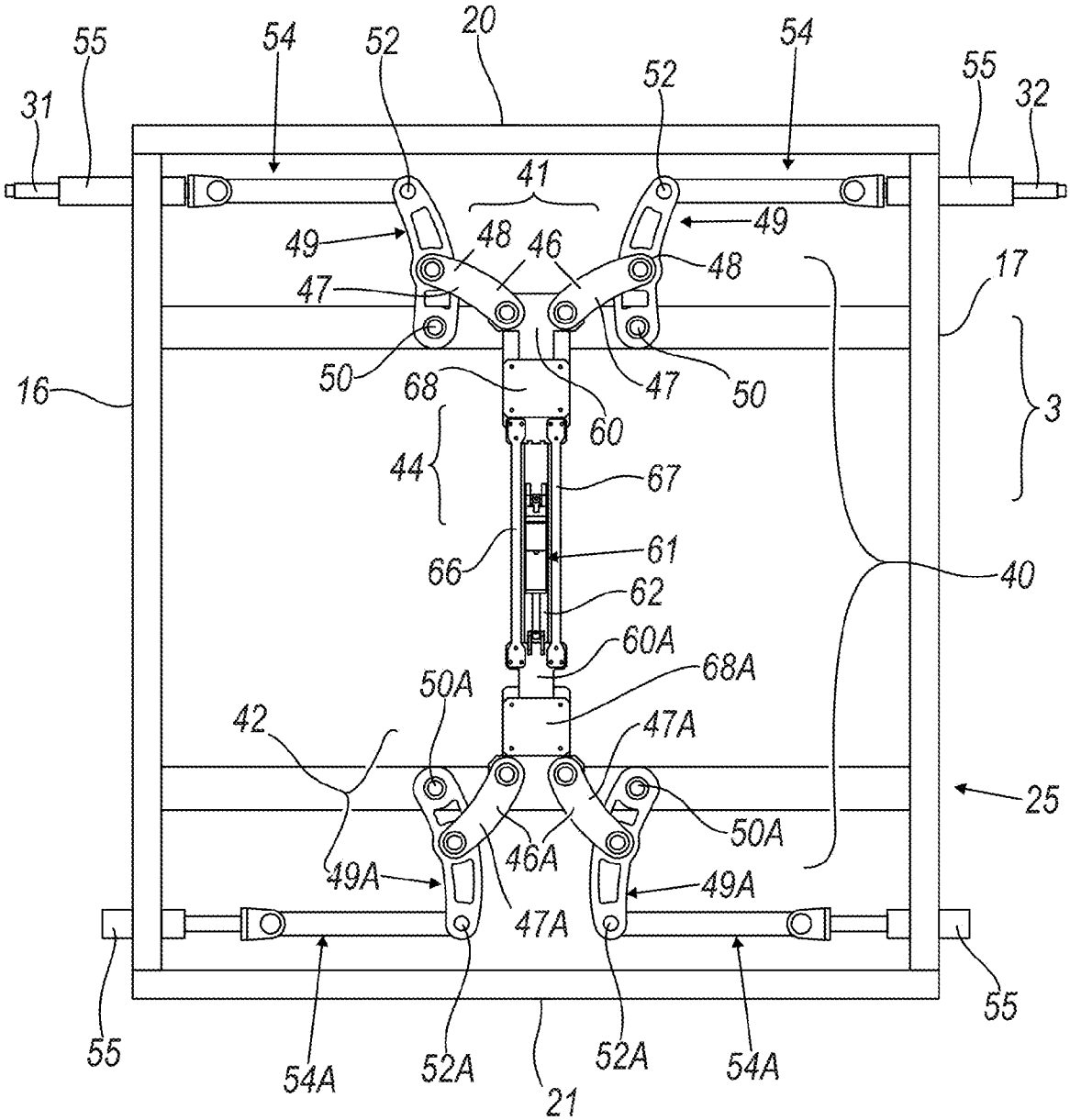
FIG. 5 shows a view of the hatch without one of its outer walls, in an arrangement adapted to allow the movement shown in FIGS. 2 and 4.
Figure 6:
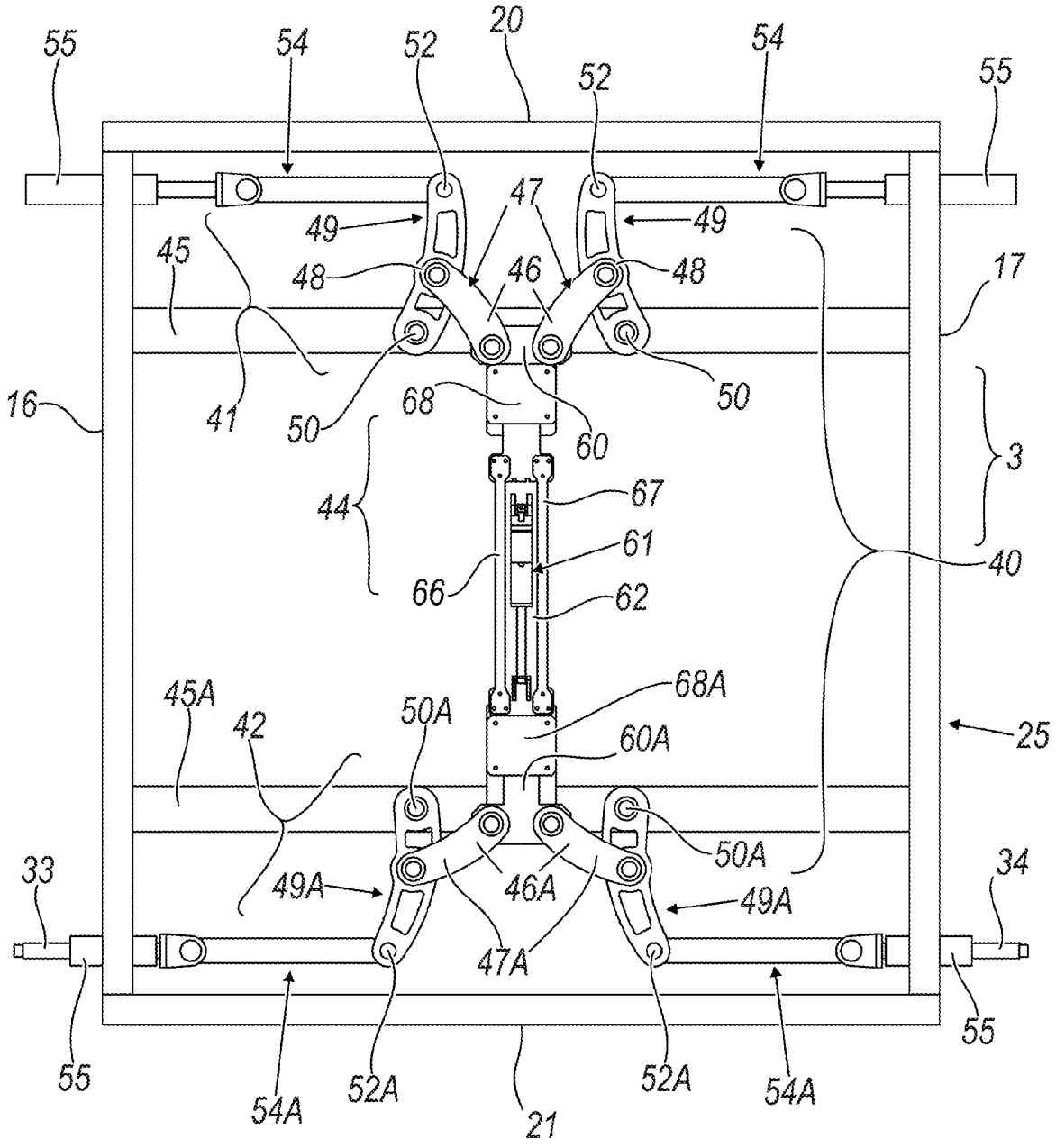
FIG. 6 shows a view similar to that of FIG. 5, but portraying the hatch used as shown in FIG. 3.
Figure 7:
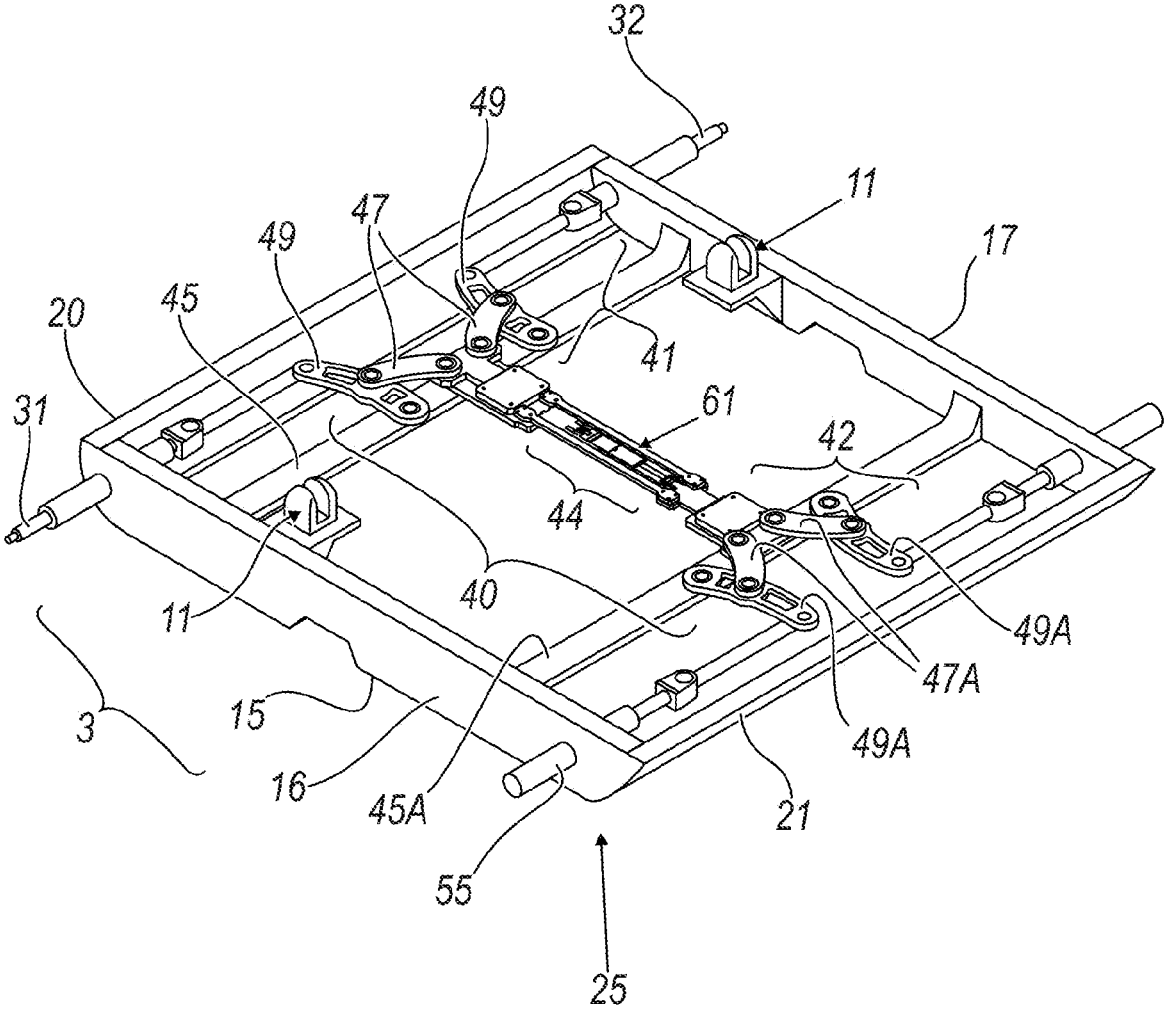
FIG. 7 shows a perspective view of the hatch arranged for use as shown in FIG. 5.

The first ends 46 of the first curved links 47 are associated with a carriage 60 of the actuator portion 44 driven by an actuator member 61, for example a motor and rack unit or a hydraulic and/or pneumatic piston placed at the position of a support 62 of this portion placed between the transverse elements 45 and 45A and fixed to the hatch 3. The actuator acts on one of these carriages 60, 60A which are interconnected by bars 66 and 67 placed on the sides of the actuator itself, the movement of a carriage to a limit point (that is to say, to a point where the bars contact a fixed stop 68, 68A placed at the ends of the support 62 near the portions 41 and 42 respectively) causing the respective pins 31-34 to protrude from the flanks 16 and 17 and allowing the hatch to be rotated upwards (FIGS. 2 and 4) or downwards (FIG. 3). This is because this movement of a carriage (for example the carriage 60 in FIG. 5) to the limit point causes a corresponding movement of the other carriage (60A) towards the (fixed) member 61 so that the pins 33 and 34 are retracted into the flanks 16, 17 of the hatch. This allows the hatch 3 to rotate about the pins or pivots 31 and 32 towards the top of the hull 2 (FIGS. 2 and 4), the hatch being moved solely by the actuators 7. These actuators are the sole actuator means capable of moving the hatch 3 into its two opening positions, that is to say the first position of FIGS. 2 and 4 in which it is opened towards the top of the hull 2 and the second opening position in which it is opened towards the bottom.

It should be noted that the openings are "equivalent" to each other, and the terms "first opening" and "second opening" are used purely for descriptive purposes.

When the carriages 60 and 60A are equidistant from the stops 68, 68A or limit points, both pairs of pins 31-34 are able to project from the sides, allowing the hatch to be closed on the mouth of the aft compartment 6. However, it is not possible for all the pins 31-34 to be retracted into the body 25 of the hatch, that is to say between its flanks 16 and 17.

Finally, the actuator portion 44 comprises means for manually operating the actuator 61 and/or for manually activating the driven portions 41 and 42. These manual operating means may comprise gearing, racks or other devices which can be activated from the outside of the hatch 3 (for example, from at least one of its inner and outer walls).

Because of the invention, the stern hatch 3 can be used as a hatch for closing the aft compartment 4 or as a "swim platform". The movement from one position to the other can always be provided, as described, by means of only one pair of actuators 7, and by appropriate operation of the actuator 61 of the actuator portion 44.

Various embodiments of the invention have been described and mentioned. However, other embodiments are possible in accordance with the above description, and are to be considered as falling within the scope of the claims below. For example, the pivot members 31-34 may be independent pins moved by corresponding electric motors or magnetic motors, this movement being produced and controlled by suitable central control members which cause these pins to move in pairs, in a similar way to that described above. These solutions are also to be considered as falling within the scope of the claims below.

The invention claimed is:

1. A boat comprising a hull having an aft stern hatch located at the position of an internal aft compartment of said hull, the hatch having a body with opposing flanks or sides pivoted on the hull and upper and lower edges, wherein the hatch comprises pivot means associated with the aforesaid flanks or sides near the upper edge and near the lower edge, the pivot means being movable towards the inside and towards the outside of these flanks so the pivot means can protrude from the flanks in combination or alternatively to each other, said pivot means for positioning the hatch to assume, alternatively, a closed position in which the hatch is closed on the compartment, a first position of opening to an upper part of the hull, and a second position of opening to a lower part of the hull.

2. A boat according to claim 1, wherein the pivot means comprise two pairs of pivot members, a first pair associated with the aforesaid flanks near the upper edge and a second pair associated with these flanks near the lower edge, the pairs of members being movable towards the inside and towards the outside of these flanks so they can protrude from the flanks in combination or alternatively, thereby allowing the hatch to be closed or opened.

3. A boat according to claim 1, wherein a device is provided within the body of the hatch for selectively moving the pivot means, the device comprising driven portions connected to these pivot means and subject to the action of an actuator portion.

4. A boat according to claim 3, wherein the driven portions comprise links pivoted with respect to each other and connected to bars connected to the pivot members, said links comprising first links subject to the action of the actuator portion.

5. A boat according to claim 4, said links comprising second links, wherein the driven portions comprise said second links pivoted on the hatch and connected to the bars connected to the pivot members.

6. A boat according to claim 5, wherein the actuator portion comprises an actuator member fixed to the hatch, acting on movable elements functionally associated with the first links of the driven portions.

7. A boat according to claim 6, wherein the actuator member is selected from the group consisting of an electric motor, acting on gearing and/or racks, and a hydraulic and/or pneumatic actuator.

8. A boat according to claim 2, wherein at least one pair of pivot members projects laterally from the flanks of the hatch.

9. A boat according to claim 6, wherein the actuator member is adapted to place the movable element, which is functionally associated with the driven portions, in one of the following positions:

a position in which only the pivot members of the first pair of pivot members protrude laterally from the hatch, in which case the pivot members of the second pair are inside the hatch;

a position in which only the pivot members of the second pair of pivot members protrude laterally from the hatch, in which case the pivot members of the second pair are inside the hatch;

a position in which all the pivot members of the first and second pair of pivots protrude laterally from the hatch, this position allowing the hatch to be closed on the aft compartment of the hull.

10. A boat according to claim 4, wherein the links of the driven portions are curved, with their concavity facing the flanks of the adjacent hatch.

11. A boat according to claim 2, wherein the pivot members are pins which are movable with respect to the flanks of the hatch.

12. A boat according to claim 3, wherein the hatch comprises an inner wall and an outer wall connected to the flanks and to the upper and lower edges, the device for the selective movement of the pivot means being placed between the walls and the flanks.

13. A boat according to claim 1, comprising means for actuating the opening of the hatch, these means adapted to place the hatch in the first opening position or in the second opening position, wherein the actuator means are at least one hydraulic and/or pneumatic actuator connected at one end to a wall of the aft compartment and at the other end to the hatch.

14. A boat according to claim 13, wherein the sole actuator means are a pair of hydraulic and/or pneumatic actuators, each of the actuators being pivoted by a first end on a wall of the aft compartment and by a second end on the hatch, this second end pivoted on a corresponding flank of the hatch.

15. A boat according to claim 1, the flanks being an opposing pair of flanks.

16. A boat according to claim 15, said pivot means for positioning the hatch to assume, alternatively, a closed position in which the entire hatch body is closed on the compartment, a first position of opening the entire hatch body to an upper part of the hull, and a second position of opening the entire hatch body to a lower part of the hull.

* * * * *